United States Patent [19]

Debrunner

[11] Patent Number: 4,829,609

[45] Date of Patent: May 16, 1989

[54] MUSCLE-POWERED SHOWER

[75] Inventor: Ernst Debrunner, Zurich, Switzerland

[73] Assignee: Ernst Debrunner AG, Zurich, Switzerland

[21] Appl. No.: 134,586

[22] Filed: Dec. 16, 1987

Related U.S. Application Data

[63] Continuation of Ser. No. 894,295, Aug. 7, 1986, abandoned.

[30] Foreign Application Priority Data

Aug. 8, 1985 [CH] Switzerland ..... 03393/85

[51] Int. Cl.[4] ..... A47K 3/22

[52] U.S. Cl. ..... 4/603; 239/469

[58] Field of Search ..... 4/602, 603, 567, 615, 4/616; 239/499, 468, 469, 153; 285/246, 247, 250

[56] References Cited

U.S. PATENT DOCUMENTS

| | | | |
|---|---|---|---|
| 1,181,676 | 5/1916 | Lambkin | 285/246 |
| 2,358,177 | 6/1943 | Madison | 239/469 |
| 4,343,435 | 8/1982 | Anderton et al. | 239/499 |

FOREIGN PATENT DOCUMENTS

| | | | |
|---|---|---|---|
| 914180 | 7/1949 | Fed. Rep. of Germany | 4/603 |
| 3013714 | 10/1981 | Fed. Rep. of Germany | 4/615 |
| 3421199 | 12/1984 | Fed. Rep. of Germany | 4/603 |
| 1441642 | 3/1966 | France | 239/499 |
| 380325 | 9/1964 | Switzerland | 4/603 |

*Primary Examiner*—Henry J. Recla
*Assistant Examiner*—Linda J. Sholl
*Attorney, Agent, or Firm*—Herbert Dubno

[57] ABSTRACT

The feed tube of the shower head is connected with a pump system operable with muscle power independently of the pressure in a water main. The pump system includes two foot operable bellows which are operable with rocking and/or alternating steps of the user to draw up water from a source and/or into the feed pipe. The shower head is so constructed that the feed duct in the handle of the shower head is tapered toward the shower head and opens out tangentially in the upper curved or arched region of a bell shape portion of the shower head. A baffle plate is positioned centrally projecting interiorly near the water inlet to the bell shape portion of the shower head dividing the water stream and a shower plate is mounted in the lower part of the bell shape portion closing it. Advantageously the shower plate has a plurality of radially directed baffle members positioned interiorly between a plurality of shower outlet holes. This structure produces a stronger shower stream.

3 Claims, 2 Drawing Sheets

MUSCLE-POWERED SHOWER

This is a continuation of co-pending application Ser. No. 894,295, filed on Aug. 7, 1986, now abandoned.

FIELD OF THE INVENTION

My present invention relates to a shower apparatus and, more particularly, to a shower apparatus in which water flow is produced by a muscle-powered pump system.

BACKGROUND OF THE INVENTION

It is known to provide a shower apparatus whose shower head, which can be hand held is connected by its handle and by a feed tube or pipe with a pump system operable by muscle power where the pressure in a water main or conduit is unavailable or insufficient.

In this shower apparatus a too gentle water flow from the shower head remains a substantial problem. This has its origin in the fact that in an apparatus operable by muscle power the shower head which was used was the same as that for a shower which is connected with a water main or conduit which delivers water with a considerable water pressure without considering that in the first case water was available only with a considerably reduced pressure.

OBJECTS OF THE INVENTION

It is an object of my invention to provide an improved muscle-powered shower apparatus which obviates these drawbacks.

It is a further object of my invention to provide an improved muscle-powered shower apparatus which produces a relatively strong water stream instead of a gentle one at a comparatively lower pressure.

SUMMARY OF THE INVENTION

These objects and others which will become more readily apparent hereinafter are attained in a muscle-powered shower apparatus having a shower head which is connected by its handle and by a feed tube with a pump system operable by muscle power.

According to my invention a flow duct in the handle of the shower head converges or is constricted toward the shower head and then opens tangentially into an upper arched or curved region of a bell shape portion in the shower head. A central downwardly and inwardly projecting baffle is positioned directed interiorly near the water inlet of the bell shape portion dividing the water flow and a perforated shower plate is mounted in the lower part of the bell shape portion of the shower head, closing it.

These features prevent the free flow of water in the bell shape portion of the shower head where the flow could expand and then reach the shower plate with a substantial pressure drop. In my invention in contrast the water flow is highly accelerated by constriction of the flow duct and passes tangentially in the upper arched region of the bell shape portion of the shower head and flows practically without loss of speed along the wall of the bell shape portion against the shower plate where the water can issue with a comparatively high pressure.

In order to prevent an energy reducing circulation of the water, the inner side of the shower plate is suitably provided with a plurality of bar shape radially extending baffle members directed inwardly.

In order to prevent unnecessary scattering and to make the discharge compact and thus strong water stream, the shower plate according to my invention is convex as seen from the exterior and is overlapped edgewise by the edges of the bell shape portion of the shower head.

The objects of my invention are also attained in a shower apparatus in which the pump system advantageously includes two foot operable bellows which are operable with rocking and/or alternating steps of a user to draw water from a source and/or feed it to a feed tube, the bellows being connectable with the feed tube and/or draw tube by a nipple connector whose connection is pressure tight and as stable to an external pulling force as allows the simplest possible operation.

Advantageously then each nipple connector extending from its bellows end connector plug to its free end comprises a step shaped threaded fitting which receives a counternut. A cylindrical portion of a nipple which is conically tapered at its free end so that a flexible tubing can be pushed on extends from the bellows end connector plug. The gripping nut can have an inner flange which can act on the tubing in the conical region of the nipple and press the tubing against the stepped threaded plug or fitting.

Because of these features the tubing pushed on the nipple is acted on by the inner flange of the gripping nut in the conical region of the nipple and pressed into the circular gap by the counternut. This arrangement withstands a high pressure from the inside add strong pulling forces from the outside so that the connection of the tubing and the pumps is simple but also detachable.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
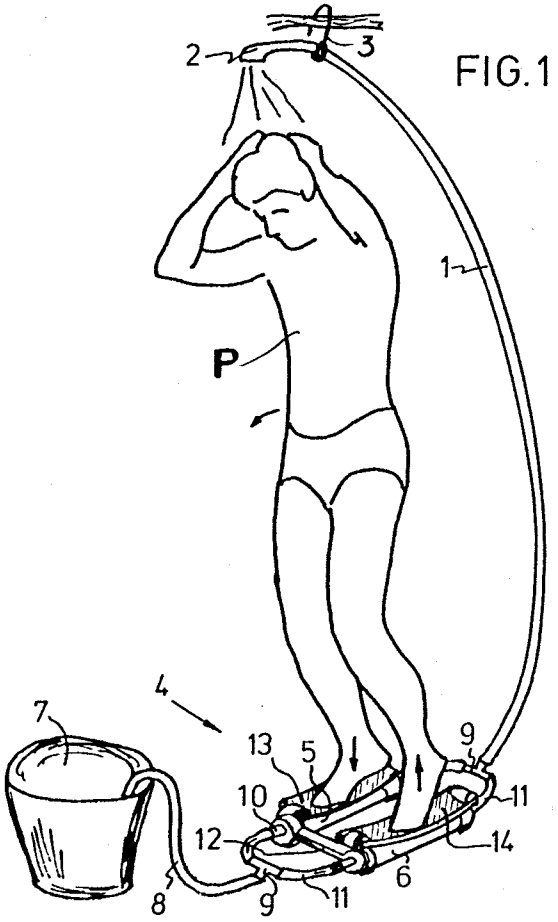
FIG. 1 is a schematic perspective view of a muscle-powered shower apparatus according to my invention in operation.

According to FIG. 1 the shower apparatus includes a feed tube 1 comprising a flexible plastic tubing to whose free end a shower head 2 is connected. Hanging means 3 are provided in order to be able to hang the shower head 2 from a branch or the like at a height above the head of a standing person P.

The feed tube 1 is connected with a pump system 4 operable by muscle-power independently of the water pressure in a water main or other conduit. The operation of this pump system 4 can be deduced from FIG. 2.

This pump system 4 includes two foot operable bellows 5 and 6 which are operable by rocking and/or alternating steps of the user P so that water is sucked from a water source 7, here a pail, and/or is fed to the feed tube 1.

The bellows 5 and 6 are connected detachably next to each other by connector tubes 11 with the feed tube 1 and a draw tube 8 by nipple connectors 9 and/or 10. These connector tubes 11 and the draw tube 8 are also composed of a flexible tubing.

The bellows 5 and 6, which can be constructed like normal foot-operated camping pumps, are formed by pieces of flexible rubber tubing, which are fastened to the ends of cross members of a frame 12. Furthermore the frame 22 has the foot plates 13 and 14 mounted on it which are connected with and act on the bellows 5 and 6 in operation.

Figure 2:
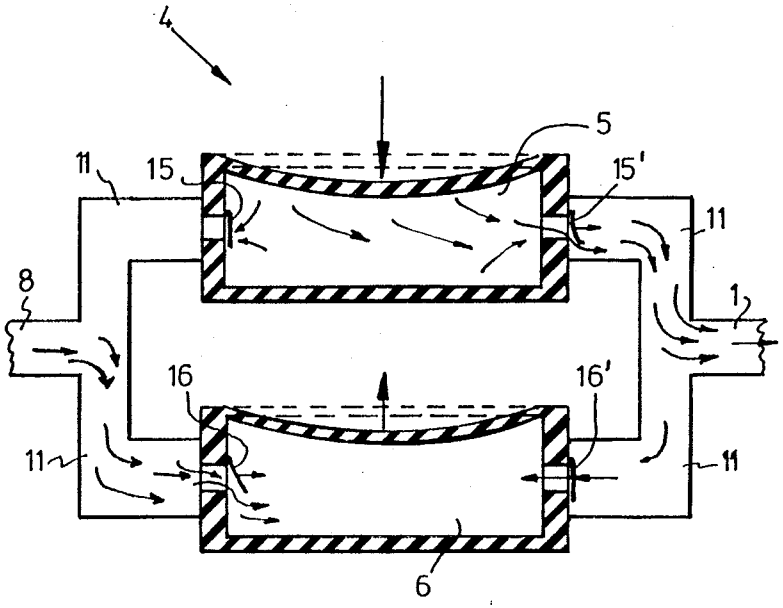
FIG. 2 is a schematic cross sectional view of the pump system of the apparatus of FIG. 1 showing its principles of operation.

The operation of this muscle-powered shower apparatus is clearly seen from the schematic illustration of the pump system 4 in FIG. 2. Accordingly each bellows 5 and/or 6 is connected on its inlet end by inlet valves 15 and/or 16 with the water source and on the outflow side by an outlet valve 15' and/or 16' with the feed tube 1. When both foot plates 13 and 14 and thus both bellows 5 and 6 are operated with rocking and/or alternating steps by the user P, a practically continuous water flow to the shower head 2 is produced whose strength depends on rhythm of the steps of the user P.

This water flow is comparatively pressureless. In order nevertheless to be able to produce a strong shower stream, the shower head 2 has the construction according to FIG. 3, in which the flow duct 30 in the handle 2' is constricted into the shower head 2 and opens tangentially in an upper curved region of a bubble shape or bell shape portion 31 of the shower head 2. In the bell shape portion 31 a baffle plate 32 projecting centrally to the interior is positioned near the water inlet 2*a* of the bell shape portion 31 of the shower head 2. A shower plate 33 is mounted in the lower part of the bell shape portion 31 closing it and the shower head 2.

To further improve the dynamic flow of the shower stream already accelerated by the tapering of the flow duct 30, the flow duct 30 is gently curved.

The baffle plate 32 projecting interiorly moreover also has a threaded eye for a mounting screw 36 for the shower plate 33.

The shower plate 33 is provided with a plurality of shower outlet holes or orifices 34 and has a plurality of bar shape radially directed baffle members 35 extending interiorly on its inside surface.

This shower plate 33 is also curved so that it appears convex from the exterior and is overlapped at its edges by the edge of the bell shape portion 31 of the shower head 2.

Figure 3A:
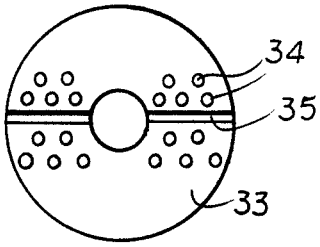
FIG. 3A is a top plan view of the shower plate of the apparatus shown in FIG. 3.
Figure 3:
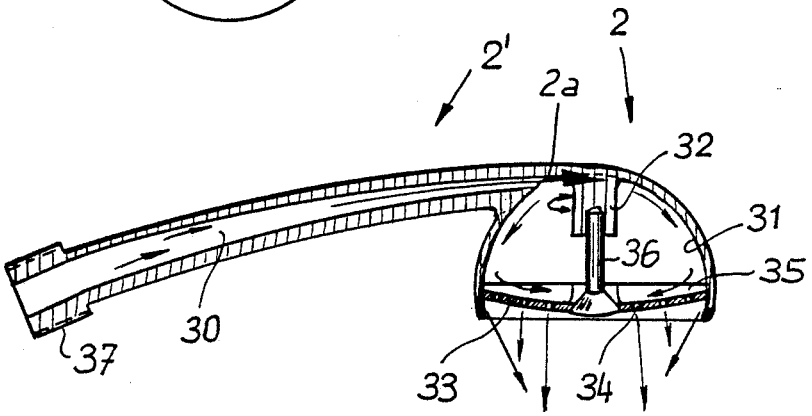
FIG. 3 is a cross sectional view of the shower head of the apparatus of FIG. 1 in a larger scale than FIG. 1.

As shown clearly by the flow arrows in FIG. 3 the water highly accelerated by the constriction in the flow duct 30 flows tangentially to the upper arched part of the bell shape portion 31 and practically without velocity decrease to the wall of the bell shape portion 31 toward the shower plate 33 where the water can flow out with a comparatively high pressure. The baffle members 35 prevent an energy reducing circulation of the water on the shower plate 33. Moreover the curvature of the shower plate 33 and its overlap by the edge of the bell shape portion 31 of the shower head 2 leads to the production of a controllable, concentrated and thus comparatively high pressure shower stream.

Figure 4:
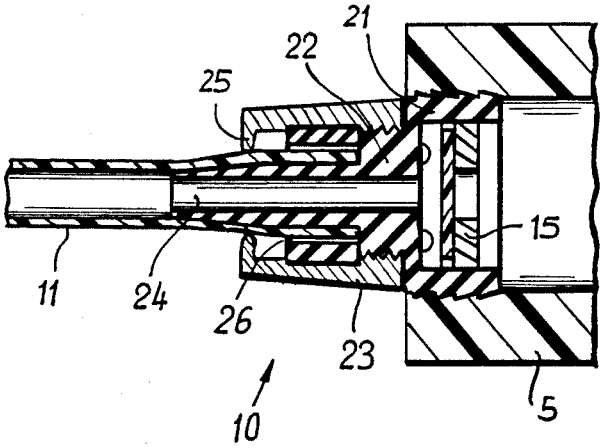
FIG. 4 is a larger-scale sectional view of a nipple connector for the tubing and the pump system of the apparatus of FIG. 1.

For a pressure tight, stable but very user friendly connection of the tubes 11 to the bellows 5 according to FIG. 4 each nipple connector 10 from its bellows end connector plug 21 to its free end comprises a threaded stepped plug or fitting 22 which receives a gripping nut 23. Also either an inlet valve 15 and/or an outlet valve 16 (in the illustration: an outlet valve) is mounted in the connector plug 21. Further a cylindrical portion of a nipple 24 extends from the connector plug 21 forming a circular gap 26 of a size approximately equal to the size of the wall of the tubing 11. Then the cylindrical portion of the nipple 24 is tapered conically until within the interior width of the tubing 11 to make easy pushing the tubing 11 on the nipple 24.

As shown in FIG. 4 by these steps the tubing 11 pushed on the nipple 24 is acted upon by a facing inner flange 25 of the gripping nut 23 in the conical region and is pressed on in the circular gap 26 by the gripping nut 23.

Such a structure for the connectors stands up to a high pressure from the interior or to strong pulling forces acting on the exterior. The connection of the tubing and the pump is very simple and also is detachable.

I claim:

1. A hand-held shower apparatus for a muscle-powered-displacement shower, comprising:

means forming a tubular handle connectable at one end to a source of water which can be displaced through said handle by muscle power;

means forming a bell-shaped head at an opposite end of said handle, said head being formed with a spherically arched chamber opening directly outwardly at a mouth of said head, said handle being formed with a passage opening at said opposite end of said handle tangentially along a wall of said chamber toward an apex thereof, said passage tapering from said one end of said handle toward said chamber;

a baffle plate extending from said apex toward said mouth along an axis of said chamber and intercepting water discharged from said pressure into said chamber and dividing the stream of intercepted water; and a perforated shower plate extending across said mouth transversely to said axis, said shower plate being formed in said chamber with a plurality of inwardly directed radially bar-shaped baffle members on an inner surface thereof.

2. The shower apparatus defined in claim 1 wherein said shower plate is curved outwardly so as to be outwardly convex.

3. The shower apparatus defined in claim 2 wherein said shower plate is overlapped edgewise by an edge of said head at said mouth.

* * * * *